US009835162B2

(12) United States Patent
Koeller et al.

(10) Patent No.: US 9,835,162 B2
(45) Date of Patent: Dec. 5, 2017

(54) DEVICE AND METHOD FOR RELIABLY OPERATING A COMPRESSOR AT THE SURGE LIMIT

(75) Inventors: Malte Koeller, Ribnitz-Damgarten (DE); Olaf Magnor, Braunschweig (DE); Daniel Reitebuch, Berlin (DE)

(73) Assignee: IAV GMBH INGENIEURGESELLSCHAFT AUTO UND VERKEHR, Berlin (DE)

( * ) Notice: Subject to any disclaimer, the term of this patent is extended or adjusted under 35 U.S.C. 154(b) by 1041 days.

(21) Appl. No.: 13/824,452

(22) PCT Filed: Sep. 19, 2011

(86) PCT No.: PCT/DE2011/001739

§ 371 (c)(1),
(2), (4) Date: May 16, 2013

(87) PCT Pub. No.: WO2012/095062

PCT Pub. Date: Jul. 19, 2012

(65) Prior Publication Data

US 2013/0223981 A1 Aug. 29, 2013

(30) Foreign Application Priority Data

Sep. 24, 2010 (DE) ..... 10 2010 046 490

(51) Int. Cl.
*F04D 27/00* (2006.01)
*F04D 27/02* (2006.01)

(52) U.S. Cl.
CPC ..... *F04D 27/00* (2013.01); *F04D 27/001* (2013.01); *F04D 27/02* (2013.01); *F05D 2270/101* (2013.01); *F05D 2270/708* (2013.01)

(58) Field of Classification Search
CPC ..... F04D 27/00; F04D 27/001; F04D 27/02; F04D 27/0223; F05D 2270/708; F05D 2270/101; F01D 21/003
See application file for complete search history.

(56) References Cited

U.S. PATENT DOCUMENTS 4,518,917 A 5/1985 Oates
4,573,358 A 3/1986 Luongo
(Continued)

FOREIGN PATENT DOCUMENTS

DE 102008036305 A1 2/2010
EP 1980719 A2 10/2008

*Primary Examiner* — Gregory Anderson
*Assistant Examiner* — Danielle M Christensen
(74) *Attorney, Agent, or Firm* — Leydig, Voit & Mayer, Ltd.

(57) ABSTRACT

A method is used for determining an operating point of a compressor that includes at least one impeller, compressor blades attached to the impeller, a housing and at least two sensors. The method includes calculating a deflection of the compressor blades. An operating point and a surge margin with respect to a surge limit are determined based on the calculating of the deflection by measuring passage times of the compressor blades at a sensor. A signal that is representative of a rotation speed is determined and is associated with the compressor impeller. In a learning or adaptation mode, compressor blade-specific, state-induced and position-induced deviations from an ideal state are determined using compressor blade-specific passage times that are measured and compared with ideal passage times. In a working mode, compressor blade-specific passage times are measured and the compressor blade-specific passage times are corrected using the determined state-induced and position-induced deviations.

7 Claims, 1 Drawing Sheet

(56) References Cited

U.S. PATENT DOCUMENTS

| | | | |
|---|---|---|---|
| 4,955,269 | A | 9/1990 | Kendig |
| 6,474,935 | B1 | 11/2002 | Crotty |
| 2009/0078051 | A1 | 3/2009 | Twerdochiib |

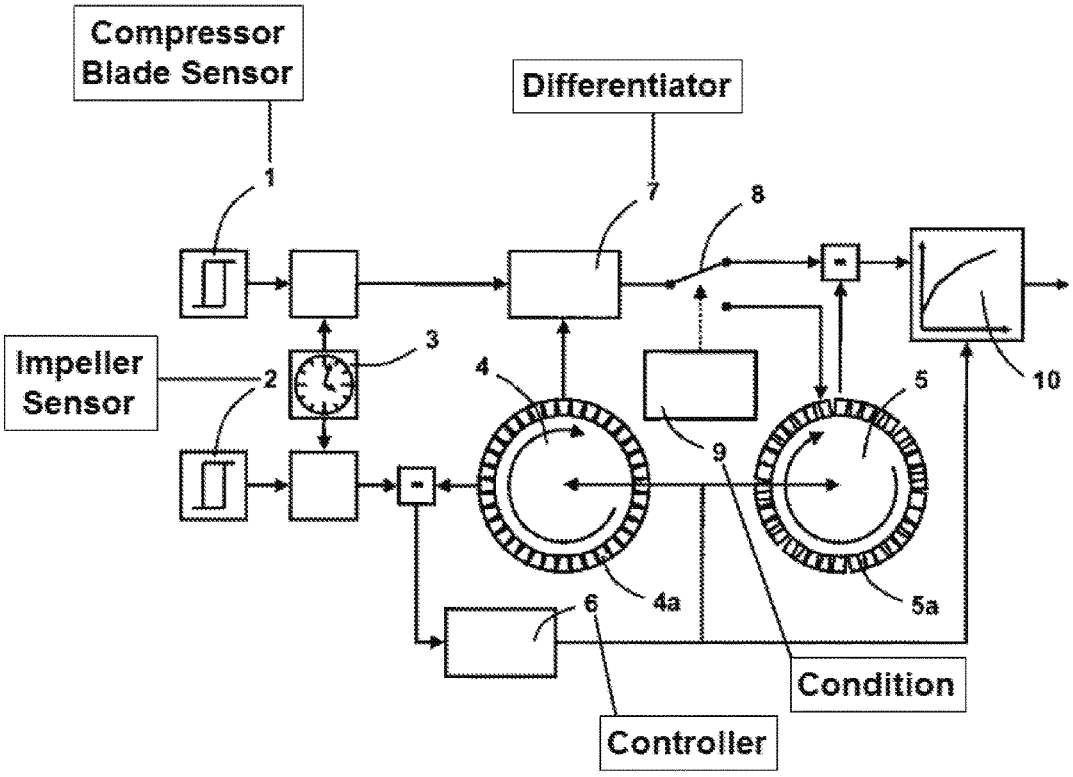
Compressor Blade Sensor
Differentiator
1
7
8
Impeller Sensor
2
3
4
5
10
9
4a
5a
6
Condition
Controller

DEVICE AND METHOD FOR RELIABLY OPERATING A COMPRESSOR AT THE SURGE LIMIT

CROSS REFERENCE TO RELATED APPLICATIONS

This application is a U.S. National Phase application under 35 U.S.C. §371 of International Application No. PCT/DE2011/001739, filed on Sep. 19, 2011, and claims benefit to German Patent Application No. DE 10 2010 046 490.2, filed on Sep. 24, 2010. The International Application was published in German on Jul. 19, 2012, as WO 2012/095062 A1 under PCT Article 21 (2).

FIELD

The present invention relates to a device and to a method for reliably operating a compressor at the surge limit.

BACKGROUND

Compressors are thermal fluid flow machines and are used for compressing gases, in particular air. Compressors find extensive application in engine construction for internal combustion engines operating on a continuous or intermittent basis and are used to compress the air required for combustion for example in reciprocating piston engines for increasing power, in gas turbines for generating electrical energy or in reaction engines for driving aircraft. The driving of the compressor is carried out for example by utilising the energy contained in the exhaust gas, but it may also be carried out in a mechanical or an electrical manner.

According to the field in which it is used, for example in a reaction engine, the compressor may be designed as an axial-flow compressor in order to achieve high mass flow rates. "Mass flow rate" shall be understood to mean an air mass which is conveyed by the compressor over a specific period of time. Alternatively, variables relating to geometric or environmental conditions, such as throughput or volumetric flow rate, may also be used to characterise the operation of the compressor. The air to be compressed flows axially against the compressor from the surroundings and is conveyed by the compressor in the reaction engine and thereby compressed. For this purpose, the compressor is generally composed of an impeller comprising compressor blades which is mounted on a shaft, which impeller rotates in a housing comprising corresponding guide blades and thus forms a compressor stage. The compressor blades, each provided with a blade base, are fitted to the impeller with play, in such a way that, in the event of a sufficiently fast rotation of the impeller on account of the occurrence of an outwardly directed centrifugal force, the compressor blades centre themselves and are embedded in the impeller. Alternatively, the blades are rigidly connected to the impeller. The guide blades are rigidly arranged at the housing. To increase the compression, a plurality of compressor stages can be arranged one behind the other in the compressor for reaction engines, thereby forming a multistage compressor. Furthermore, a fan and a second compressor can be connected upstream of the compressor. The impeller is driven by a shaft that is driven by a turbine at the end of the reaction engine.

When operating the compressor, the compressor power is set by the rotational speed of the impeller and by the mass flow rate in the compressor. For this purpose, for example the driving power of the shaft can be altered by the turbine, in order to set the rotational speed of the impeller. The mass flow rate in the compressor can be varied by means of adjustable guide blades or blow-off valves or by altering the blade tip clearance. In this manner, it is possible to set an operating point for the compressor, which operating point is defined for example by a pressure ratio and a mass flow rate, by compressor power and rotational speed or other alternatives.

The maximum pressure ratio of a compressor stage is limited in that the compressed air in the compressor stage is unable to follow the compressor blade contour arbitrarily, but rather separates, starting from the trailing edge of the compressor blade. The maximum stage pressure ratio rises as the mass flow rate increases, constituting the absolute limit of the stable operating range as the surge limit. The maximum mass flow rate of the compressor stage is limited by a stopper limit as soon as a velocity of flow corresponding to the velocity of sound forms in a flow cross-section, typically at the compressor entrance, and thereby limits the implemented mass flow rate.

Depending on the angle of attack or on the inflow velocity of the air onto the compressor blade, there is a difference in pressure between the upper face and the lower face. Since a compressor blade is a resilient component, it will yield to the difference in pressure between the upper face and the lower face and sag. As the load increases, the sag and thus the deflection of the compressor blades become more marked.

The operating range of the compressor is thus limited by the surge limit and by the stopper limit. In this case, the surge limit is an unfavourable, unstable operating state for the compressor, which state can lead to the destruction of the compressor. Especially when the compressor is used in reaction engines, it is absolutely essential to avoid this unstable operating state, in order to ensure operational reliability.

Surges arise if the mass flow rate required for a pressure ratio across a compressor stage is too low, or the pressure ratio for a specific mass flow rate is too large, thereby causing backflow and thus a stall. In this manner, the pressure ratio and the mass flow rate are altered momentarily, as a result of which the operating point is momentarily in the stable range and thereafter the unstable operating point in turn arises. This cyclical switching between the stable and the unstable operating state close to the surge limit may occur for example only at some compressor blades, only individual compressor blades experiencing a stall and this effect continuing counter to the direction of rotation of the compressor impeller. The cyclical switching of the flow causes cyclically alternating loads on individual compressor blades. Owing to the increasing stall and the alternate loading associated therewith, the compressor blade starts to vibrate, the compressor blades sagging as a result of this alternate loading and possibly breaking. However, if an unstable operating state exceeding the surge limit arises, this causes, however, a complete stall and considerable pressure surges in the compressor. In the power plant as a whole, this state poses a considerable danger on account of extinguishing flames, burning fuel in the compressor, overheating, deformations, etc., the compressor and thus the reaction engine possibly being completely destroyed.

The progression of the surge limit of the operating range is subject to operationally-induced and age-induced changes. The surge limit is thus influenced by changes in the environmental conditions during flight, inflow conditions of the compressor, by the thermal inertia of the components and by the penetration of foreign objects. Changes in the tip clearance of the compressor blades with respect to the housing, changes in the bearing play due to aging and wear, deformations and fouling of the blade geometries and at the housing also influence the surge limit.

A sufficiently large pressure ratio margin of the permitted operating states of the compressor with respect to the surge limit should allow for the reduction in the surge limit to lower pressure ratios which is triggered by these influences. The critical operating state is reached when the compressor accelerates, in the case of which compressor the surge limit margin is provisionally lowered. In practice, the surge limit margin for new power plants is set to be approximately 25% of the pressure ratio, in such a way that, by the end of the service life of the compressor, it has fallen to 5% owing to the age-induced reduction in the surge limit.

The optimum efficiency of a compressor is generally close to the surge limit, in the stable operating range, and this gives rise to a disadvantage of use due to the safety-relevant setting of the surge limit margin. Therefore, the prior art discloses devices and methods intended for operating compressors and for protecting the compressors from this dangerous operating state at optimum compressor efficiency. For example, blow-off valves are used to reduce the pressure ratio across a compressor stage. In many cases, an adjustment of rotatably mounted guide blades is provided, with which guide blades the pressure ratio or mass flow rate can be varied in order to thus ensure a reliable, stable operating state. Furthermore, actively changing the tip clearance of the compressor blade through heating or cooling the compressor housing is known. As a pre-condition in this regard, it is, however, necessary to reliably detect the operating state of the compressor and, accordingly, the surge margin of the current operating point of the compressor with respect to the surge limit.

The deflection of the compressor blade tip can be calculated from the temporal difference of the measured passing time of the compressor blade tip at one sensor at the housing and an ideal passage time that would occur with a compressor blade of ideal rigidity, and from the known tangential velocity of the compressor blade tip. "Passage time" shall be understood to mean the time at which the compressor blade tip is located, at least in part, in the sensor region of the sensor at the housing of the compressor. In this case, for example, entry into the sensor region, passage through the sensor region or exit from the sensor region may be defined in order to define the passage time.

U.S. Pat. No. 6,474,935 B1 describes the detection of rotating separations on the basis of the measurement of the deflection of the compressor blade tips due to pressure fluctuations caused by the rotating stall cell.

The method thus relates to the identification of precursors of an unstable compressor state. It is known that these precursors appear a few milliseconds prior to the onset of compressor instability, meaning that insufficient time now remains for performing counter measures, for example reducing the fuel mass, opening the blow-off valves or adjusting the guide blades.

DE 10 2008 036 305 A1 describes a method in which input power of the compressor is determined from the passage times of individual compressor blades. For this purpose, the real passage times are compared with the ideal model passage times, and the difference therebetween is evaluated as a consequence of the compressor blades having sagged. It is possible to calculate a compressor moment from the sag of the compressor blades and, accordingly, to calculate a compressor power using the rotational speed of the compressor. In the stable operating state, there is an equilibrium between the driving power and the compressor power. Any upset to the equilibrium of power is seen as oncoming instability and it is indicated that the surge limit is being approached.

The state, such as wear, soiling, erosion and deformations at the compressor blades, and changes in the position of the compressor blades, which re-orientate themselves by means of the blade base play upon each power plant start-up, influence the measured passage time with respect to the nominal passage time, on the basis of which the sag or deflection of the compressor blades is determined and a conclusion is drawn as regards the operating point and the surge margin thereof with respect to the surge limit. The methods known in the prior art are unable to detect and eliminate this influence, meaning that faulty detections may arise. It is not possible to reliably determine the operating point of the compressor and thus the surge limit margin of the operating point.

SUMMARY

In an embodiment, the present invention provides a method used for determining an operating point of a compressor that includes at least one impeller, compressor blades attached to the at least one impeller, a housing and at least two sensors. The method includes calculating a deflection of the compressor blades. An operating point and surge margin with respect to a surge limit are calculated based on the calculating of the deflection by measuring passage times of the compressor blades at a sensor. A signal that is representative of a rotation speed is determined and is associated with the compressor impeller. In a learning or adaptation mode, compressor blade-specific, state-induced and position-induced deviations from an ideal state are determined using compressor blade-specific passage times that are measured and compared with ideal passage times. In a working mode, compressor blade-specific passage times are measured and the compressor blade-specific passage times are corrected using the determined state-induced and position-induced deviations.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawing which illustrates the following:

FIG. 1 shows a schematic view of the device for reliable operation of a compressor at the surge limit.

DETAILED DESCRIPTION

In an embodiment, the present invention provides a method and a device which allow reliable detection of the operating state of the compressor. The detection preferably takes place independently of influences from a changed state or a changed position of the compressor blades.

The state of each individual compressor blade, such as wear, soiling, erosion and deformations, define a deviation from an ideal state and influence the real measured passage time. "Passage time" shall be understood to mean the time at which the compressor blade tip is located, at least in part, in a sensor region of a sensor at the housing of the compressor. In this case, for example, entry into the sensor region, passage through the sensor region or exit from the sensor region may be used to define the passage time.

The position of each individual compressor blade at the impeller may change upon each start-up. Since the compressor blades are mounted in the impeller with play and automatically align and anchor themselves in the guide only when the compressor is started up at a minimum rotational speed owing to the centrifugal force, these deviations come about with passing operational use. Even with compressors comprising compressor blades that are rigidly arranged on the impeller, a change in position can take place on account of assembly procedures.

All deviations impact the passage time and thus cause a difference between measured and ideal passage time. "Ideal passage time" shall be understood to be any time that would occur in the case of an ideal impeller comprising an equidistant compeller blade arrangement and infinitely rigid compressor blades without deviations from state and position.

"Passage time" shall be understood to be the time at which the compressor blade tip is located, at least in part, in the sensor region of the sensor at the housing of the compressor. In this case, for example, entry into the sensor region, passage through the sensor region or exit from the sensor region may be defined in order to define the passage time.

The deviations from the ideal passage time of the compressor blades from state and position are considered to be unchangeable during operational use of the compressor. "Operational use" shall be understood to be the operation of the compressor between start-up and shutdown, that is between starting and stopping.

If, upon start-up, the compressor has reached the minimum rotational speed for automatic alignment of the compressor blades, the compressor blades align themselves. The deviations of the compressor blade from the ideal state in terms of state and position remain constant for this operational use and may be compensated. Only when the compressor shuts down at a specific minimum rotational speed do the compressor blades slacken in accordance with the base play and the deviations are again indefinite.

The invention provides a method which allows reliable detection of the operating state independently of the state and position of the compressor blades and which thus allows optimum compressor operation. In an advantageous manner according to the invention, the deviations from the ideal state of each individual compressor blade are determined upon start-up of the compressor after reaching the minimum rotational speed for aligning the compressor blades. The passing times of each compressor blade, said passing timed being measured during operation, can be corrected on the basis of this deviation established for the individual compressor blades. This correction allows precise determination of the operating state and an optimally efficient operation of the compressor below the surge limit. Each time the compressor is started, the deviations of the compressor blades with respect to the ideal state are re-determined, adapted and incorporated in the evaluation. The thus corrected measured passage times are used to determine the deflection caused by the sag of the compressor blade, advantageously only the sag caused by the flow mechanics being determined according to the invention. The operating point is determined independently of the state and position of the compressor blades.

The invention further provides a device for determining the deviations and correcting the passage times. The device includes at least one sensor for indicating the passage of a compressor blade, hereinafter referred to as the compressor blade sensor, and at least one sensor for indicating the rotation of the impeller, hereinafter referred to as the impeller sensor. The compressor sensor outputs a trigger signal when a compressor blade passes by. To improve the trigger signal, a marking or similar can be provided on the compressor blade tip. The passage time is determined from the signal. The impeller sensor outputs a trigger signal according to the rotation of the impeller. The rotational speed of the impeller can, for example, be calculated therefrom. It is possible to provide corresponding markings at this point too. To enhance the precision of the rotational speed detection, a plurality of markings can be provided, in order to detect a plurality of trigger signals during rotation of the impeller, in order to more precisely represent any fluctuations in rotational speed. However, one marking is generally sufficient, since the rotational speed is subject to very low fluctuations in rotational speed owing to the inertia of the impeller.

The trigger signals of the sensors are related to one another by means of a central time base, in such a way that precise allocation of the trigger signals and compressor blades is able to take place. Thus, a comparison between the measured and the ideal passage time is able to take place for each individual compressor blade via the relationship of the compressor blade sensor and impeller sensor.

In addition to the real impeller, in an advantageous manner according to the invention, a compressor nominal model is used, which represents the impeller comprising the compressor blades as an ideal impeller comprising an equidistant compeller blade arrangement comprising infinitely rigid, ideal compressor blades without deviations from state and position. The compressor nominal model can be represented as a storage map in which storage cells equating to the number of compressor blades are provided. An individual storage cell is allocated to each individual compressor blade. The compressor nominal model of the measured rotational speed of the impeller is adapted in phase by means of any given controller, preferably a PID controller, in such a way that a direct comparison is possible between the real impeller and the ideal impeller, as represented by the compressor nominal model. In this manner, a storage cell rotation equating to the rotation of the real impeller is achieved. Alternatively, a counter that is synchronised with the rotation of the impeller can be used, with which the individual storage cells of the storage map can be activated. The compressor nominal model then supplies the individual ideal passage time, that is the time that a geometrically ideal and infinitely rigid compressor blade would generate at the sensor, for each individual compressor blade passing at the compressor blade sensor. The difference between the ideal passage time and the real passage time of a particular compressor blade, which passage time is measured at the compressor, gives the deviation, that is, the relative passage time. For this purpose, the device according to the invention provides a differentiator for performing the corresponding operation. The relative passage time is equal to zero for the ideal case and in the real case is composed of a state-induced and position-induced deviation and the actual useful signal, that is the flow mechanics-induced deviation.

In the case of a very low rotational speed of the compressor, for example in the idling state or when the power plant is starting, the portion of the deviation that is induced by flow mechanics can be considered to be negligibly small, in such a way that the state-induced and position-induced deviation is dominant. This state-induced and position-induced deviation is allocated to a compressor adaptation model in a compressor blade-specific manner, the compressor adaptation model, like the compressor nominal model, having a corresponding number of storage cells. For this purpose, in the device, the compressor adaptation model is, according to the invention and in addition to the compressor nominal model, integrated with a switching unit, which is used to switch between the working mode and the learning- or adaptation mode. If the adaptation mode is enabled, for example by rotational speed thresholds of the impeller, adaptation can take place. In the working mode after start-up and operation of the reaction engine, the compressor blade-specific state-induced and position-induced deviations from the compressor adaptation model are used in order to correct the relative passage time of the particular compressor blade with respect to a corrected relative passage time, in such a way that only the flow mechanics-induced portion is now calculated for calculating the deflection of the compressor blade. The state-induced and position-induced deviations stored in the compressor adaptation model can be recorded as a margin or as a factor, in the form of a time, a displacement or an angle, etc. In order to correct the state-induced and position-induced deviations of each individual compressor blade, use can be made of the measured passage time or of the relative passage time calculated therefrom. Furthermore, the rotational speed of the impeller, or the tangential velocity of the compressor blade tips, is used to calculate an absolute deviation as a displacement or angle with respect to the ideal state. Furthermore, geometric parameters of the compressor and the components thereof can be incorporated in the evaluation. Advantageously, the compressor nominal model can be combined with the compressor adaptation model.

Since the deflection of the compressor blade according to the mass flow rate is not monotonic, but has a maximum below the surge limit, the compressor power calculated from the deflection is ambiguous. This problem is solved in that the change in deflection is monitored during operating point changes. In principle, the operating point change can take place by compulsory modulation of the fuel mass flow rate. This is, however, not necessary, since the fuel mass flow rate is in any case continuously varied both by throttle lever adjustments made by the aircraft pilot and by control activities of the autopilot.

This information concerning corrected related passage time, compressor blade deflection and the progression thereof can, together with the knowledge regarding the rotational speed of the compressor and the pressure differential of the power plant as a whole, be used to draw a conclusion as regards the current operating point of the compressor and thus as regards the current surge margin of the operating point from the surge limit.

To improve the method according to the invention, a sensor configuration can be used which consists of at least two compressor blade sensors and an impeller sensor. Where only one sensor is present, it is not possible to detect blade vibrations having a frequency which is the same as or several times the impeller frequency. By increasing the number of compressor blade sensors and the irregular distribution thereof about the compressor periphery, it is possible to detect these frequencies too. Sensors having different working modes can be used. A combination of passage-sensitivity and spacing-sensitivity would, however, bring about the advantage of allowing clearance adjustment for the compressor blades.

Calculation of the inflow angle from the available information lends itself as an extension of the method according to the invention. The calculated inflow angle is continuously entered into a recordable map and the operating map of the power plant is thus determined and retained over the course of the operating time of the power plant. It is additionally known from experiments on the test floor which inflow angle leads to stall and thus to compressor surging, in such a way that the surge limit is securely recorded in the map. Non-volatile storage characteristics ensure that this information is retained even after the power plant shuts down, in such a way that there is a fixed reliability threshold for stable operation of the reaction engine.

The method according to the invention can be used on one compressor stage or on selected or a plurality of compressor stages which are most at risk of surging.

The method according to the invention is suitable not only for detecting compressor instabilities by means of a consideration in terms of the compressor blades, but also for distinguishing between rotating separations and compressor blade flutters, since rotating separations rotate counter to compressor blade flutters. The method according to the invention allows optimum setting of the actuators of a compressor, since the actual operating state of the compressor and the position of the surge limit are known. The compressor can thus operate at optimum efficiency, without it being necessary to enter into the unstable operating state. This reduces specific consumption. A simpler and also smaller design of the compressor is, for example, possible.

The method according to the invention does not require start-up at the surge limit to be able to determine the position thereof. This increases safety.

The method according to the invention perpetually adapts the operating map, in such a way that the operation of the compressor is continuously adapted to its aging state. This reduces specific consumption. Should, for example, compressor instability occur, which can be detected by the method, this behaviour is corrected in the operating map by adapting the surge limit.

The method according to the invention predicts the failure behaviour of the compressor, in such a way that unscheduled maintenance is avoided and the available service life is known. This reduces costs associated with operation, maintenance and storage as well as standard costs, and enhances availability.

The method according to the invention is additionally compatible with methods of active clearance control, in which the clearance between the compressor blade tips and the housing is controlled or adjusted. Furthermore, the use of variable guide blades and the diminution of engine bleed is optimised.

The device configured by way of example consists of a compressor blade sensor (1), which outputs a trigger signal according to the passage of a compressor blade, and an impeller sensor (2), which outputs a trigger signal according to a rotation of the impeller of the compressor. The two trigger signals are provided with a time stamp by means of a central time base (3). Furthermore, the device is equipped with a compressor nominal model (4) and a compressor adaptation model (5) which run in phase with respect to the rotational speed of the impeller by means of a controller (6). The controller carries out an intervention appropriate to any control deviation. The compressor nominal model (4) and the compressor adaptation model (5) consist, for this purpose, of a plurality of storage cells (4*a*, 5*a*), the number of storage cells for each model corresponding to the number of compressor blades. The controller (6) activates the storage cells in phase according to the rotational speed of the impeller. The compressor nominal model (4) outputs an ideal passage time corresponding to the current compressor blade, which is compared in a differentiator (7) with the measured passage time, and outputs a relative passage time.

Thereafter, the state deviations and position deviations of the particular compressor blade, which deviations have been adapted in a learning mode, are calculated from the compressor adaptation model (5) having the relative passage time. In order for the compressor adaptation model (5) to be able to be adapted, a switch (8) is provided which switches into an adaptation mode if a condition (9) is met. If the condition (9) is not met, the device is operated in the working mode. The device outputs at least one piece of information concerning the operating point, which was calculated from the corrected relative passage time and further variables in an evaluation unit (10).

In an alternative configuration of the device, the compressor nominal model (4) can be replaced by a function which outputs the ideal passage time according to the rotational speed of the impeller, since this remains the same for all compressor blades and the model assumption of the ideal impeller.

In an alternative configuration of the device, the compressor adaptation model (5) can be replaced by a map, the map points of which can be activated discretely and output the deviation of the particular compressor blade. The map points can take place for example by means of a counter that is synchronised with the impeller.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

LIST OF REFERENCE NUMERALS

1 Compressor blade sensor
2 Impeller sensor
3 Time base
4 Compressor nominal model
4*a* Storage cell
5 Compressor adaptation model
5*a* Storage cell
6 Controller
7 Differentiator
8 Switch
9 Condition
10 Evaluation unit

The invention claimed is:

1. A method for operating a compressor including at least one impeller, compressor blades attached to the at least one impeller, a housing, at least one actuator, and at least two sensors, the method comprising:

measuring passage times of the compressor blades at a sensor;

determining a signal that is representative of a rotation speed of the compressor impeller;

determining, in a learning or adaptation mode, compressor blade-specific, state-induced and position-induced deviations from an ideal state using compressor blade-specific passage times that are measured and compared with ideal passage times;

measuring, in a working mode, compressor blade-specific passage times;

in the working mode, using the determined state-induced and position-induced deviations to correct the compressor blade-specific passage times and uses the corrected compressor blade specific passage times to set the at least one actuator.

2. The method according to claim 1, wherein the compressor blade-specific, state-induced and position-induced deviations of the compressor blades are determined upon start-up of the compressor after alignment of the compressor blades.

3. The method according to claim 1, wherein the compressor blade-specific, state-induced and position-induced deviations are determined after a minimum rotational speed of the impeller is reached.

4. The method according to claim 1, wherein the compressor blade-specific, state-induced and position-induced deviations are stored as a margin or as a factor, in the form of a time, a displacement or an angle.

5. The method according to claim 1, wherein the compressor blade-specific, state-induced and position-induced deviations are stored in an adaptation mode in a compressor adaptation model and read out in a working mode.

6. A device for determining an operating point of a compressor that includes an impeller with a plurality of compressor blades, the device comprising:

at least one compressor blade sensor configured to sense a passage of at least one of the plurality of compressor blades and to output a first trigger signal according to the passage;

at least one impeller sensor configured to sense a rotation of the impeller and to output a second trigger signal according to the rotation;

a time base configured to predefine a system time, the time base receiving the first trigger signal and the second trigger signal and providing the first trigger signal with the system time so as to generate measured passage times based on the first trigger signal and providing the second trigger signal with the system time;

at least one integrated storage map including a number of storage cells equating to a number of compressor blades to be monitored; and an apparatus configured to synchronize the storage map with the rotation of the impeller so as to generate ideal passage times based on the second trigger signal, or alternatively, a counter that is synchronized with the rotation of the impeller, with which the individual storage cells of the storage map can be activated, such that the measured passage times can be compared against the ideal passage times and can be corrected using the compressor blade-specific state-induced and position-induced deviations.

7. The device according to claim 6, further comprising a switch configured to be switched upon meeting of a condition in order to switch between a learning or adaptation mode and a working mode.

* * * * *